US008005384B2

(12) United States Patent
Tanaka

(10) Patent No.: US 8,005,384 B2
(45) Date of Patent: Aug. 23, 2011

(54) LIQUID DEVELOPER COLLECTING SYSTEM AND IMAGE FORMING APPARATUS INCLUDING THE SAME

(75) Inventor: Hiroshi Tanaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 395 days.

(21) Appl. No.: 12/268,948

(22) Filed: Nov. 11, 2008

(65) Prior Publication Data

US 2009/0123167 A1 May 14, 2009

(30) Foreign Application Priority Data

Nov. 14, 2007 (JP) ..... 2007-295576
May 19, 2008 (JP) ..... 2008-130608

(51) Int. Cl.
*G03G 15/10* (2006.01)

(52) U.S. Cl. ..... 399/57; 399/58; 399/233; 399/237; 399/249; 399/358; 399/359; 399/360

(58) Field of Classification Search ..... 399/57, 399/58, 233, 237, 249, 358, 359, 360
See application file for complete search history.

(56) References Cited

U.S. PATENT DOCUMENTS

| | | | | |
|---|---|---|---|---|
| 6,011,943 | A * | 1/2000 | Kim | 399/238 |
| 6,151,469 | A * | 11/2000 | Lee | 399/237 |
| 6,308,033 | B1 * | 10/2001 | Kato | 399/237 |
| 6,694,112 | B2 | 2/2004 | Sasaki et al. | |
| 6,876,822 | B2 | 4/2005 | Sasaki et al. | |
| 7,004,650 | B2 | 2/2006 | Sasaki et al. | |
| 7,171,143 | B2 * | 1/2007 | Yamasaku | 399/237 |
| 2002/0114637 | A1 * | 8/2002 | Park et al. | 399/238 |
| 2003/0175049 | A1 * | 9/2003 | Ichida et al. | 399/237 |
| 2005/0158082 | A1 * | 7/2005 | Shin et al. | 399/237 |

FOREIGN PATENT DOCUMENTS

| | | |
|---|---|---|
| JP | 2002-006637 | 1/2002 |
| JP | 2002278294 A | 9/2002 |

* cited by examiner

*Primary Examiner* — Ryan Walsh
(74) *Attorney, Agent, or Firm* — DLA Piper LLP (US)

(57) ABSTRACT

A liquid developer collecting system. A collection section collects liquid developer from a photosensitive body. A storage section stores liquid developer collected by the collection section. A first feed unit feeds liquid developer from the storage section to a concentration control unit.

6 Claims, 11 Drawing Sheets

LIQUID DEVELOPER COLLECTING SYSTEM AND IMAGE FORMING APPARATUS INCLUDING THE SAME

CROSS-REFERENCE TO RELATED APPLICATIONS

This application claims the benefit of priority under 35 USC 119 of Japanese patent application No. 2007-295576, filed on Nov. 14, 2007, and Japanese patent application no. 2008-130608, filed on May 19, 2008, which are incorporated herein by reference.

BACKGROUND

1. Technical Field

The present invention relates to a liquid developer collecting system that includes a plurality of photosensitive bodies, a plurality of developing devices that develop electrostatic latent images formed on the photosensitive bodies by using liquid developer containing a non-volatile solvent as a carrier, and a transfer body that sequentially transfers the toner images developed by transfer units corresponding to the plural photosensitive bodies and stacks the transferred toner images to reuse liquid developer collected from the photosensitive bodies after transfer, and also relates to an image forming apparatus including the liquid developer collecting system.

2. Related Art

Various types of wet-type image forming apparatus that develop latent images using high-viscosity liquid developer to visualize electrostatic latent images have been proposed. The liquid developer used in a typical wet-type image forming apparatus contains toner having solid components and dispersed in a liquid solvent. The liquid developer used by the wet-type image forming apparatus contains solid constituents (toner particles) suspended in an electrically insulating organic solvent (carrier) such as silicon oil, mineral oil, and edible oil. The toner particles are extremely fine particles having particle diameters of about 1 μm. By using such fine toner particles, the wet-type image forming apparatus can provide images having a higher quality than that of images produced by a dry-type image forming apparatus, which uses powder toner particles having particle diameters of about 7 μm.

According to this type of image forming apparatus using liquid developer, a method has been proposed that develops an electrostatic latent image on a photosensitive body with liquid developer by using a developing device, transfers a toner image on the photosensitive body to a transfer body, and collects and reuses carrier-rich liquid developer by using a cleaner that contacts the photosensitive body after transfer.

The carrier-rich liquid developer is fed to a concentration control unit by using a pump or the like. The concentration control unit also receives liquid developer collected from the developing device. Then, the concentration control unit mixes a high-concentration liquid toner that has been supplied thereto and diluted liquid developer thus collected to adjust the concentration to a target solid concentration. The liquid developer adjusted to the target solid concentration is fed to the developing device for reuse (for example, see JP-A-2002-6637).

According to the method described above, however, adjustment to the target concentration needs to be performed for the carrier-rich liquid developer collected from the photosensitive body by the cleaner as well as the liquid developer collected from the developing device by a concentration control device before reuse. In the case of a color image forming apparatus, a concentration control device for collected liquid developer is provided for each color to prevent color mixture. For meeting the demand for size reduction of image forming apparatus, the capacity of each concentration control device needs to be small.

In order to adjust the concentration of the collected carrier-rich liquid developer to the target concentration using a small-capacity concentration control device, a new toner having a high concentration is supplied to the concentration control device from a toner tank. The concentration of the new toner is about 35%. Thus, when a solid concentration of the collected entire liquid developer is 17% under the condition of a target concentration set at 20%, a predetermined amount of the new toner having the concentration of 35% needs to be supplied by the concentration control device to adjust to the target concentration. In this case, the concentration cannot be efficiently adjusted when the concentration control device does not have sufficient vacant capacity.

SUMMARY

It is an advantage of some aspects of the invention to provide a liquid developer collecting system that reduces the consumption amount of new carrier and efficiently performs concentration control by effectively using carrier-rich liquid developer collected from a photosensitive body by a cleaner in a simplified structure, and to provide an image forming apparatus including the liquid developer collecting system.

A liquid developer collecting system according to a first aspect of the invention includes: a photosensitive body; a collection section that collects liquid developer from the photosensitive body; a storage section that stores liquid developer collected by the collection section; a concentration control unit; and a first feed unit that feeds liquid developer from the storage section to the concentration control unit. In this structure, the storage section functions as a buffer tank of carrier liquid for reusing carrier-rich liquid developer collected from the photosensitive body. Thus, the consumption amount of new carrier can be reduced, and the concentration can be efficiently controlled by the concentration control unit for reuse.

The liquid developer system may further include a disposal tank and a second feed unit that feeds liquid developer from the storage section to the disposal tank. According to this structure, whether the collected liquid developer is to be reused or disposed can be quickly judged according to the amount of the collected liquid developer and variations in the solid concentration.

The liquid developer system may further include a plurality of photosensitive bodies; a collection section that collects liquid developer from at least one of the photosensitive bodies; at least one storage section that stores liquid developer collected by the collection section; a concentration control unit; and a feed unit that feeds liquid developer from the storage section to the concentration control unit. In this structure, the storage section functions as a buffer tank for carrier liquid for reusing carrier-rich liquid developer collected from the photosensitive body. Thus, the consumption amount of new carrier can be reduced, and the concentration can be efficiently controlled by concentration control unit for reuse.

The liquid developer system may further include a transfer material to which images formed on the plural photosensitive bodies are transferred. In this case, the storage section stores liquid developer collected from the photosensitive body to which an image that is transferred first in the transfer material is formed in the plural photosensitive bodies. According to this structure, color mixture that may be caused when collected carrier-rich liquid developer is reused can be prevented.

The storage section of the liquid developer system may have storage units corresponding to the respective liquid developers collected from the plural photosensitive bodies. According to this structure, carrier-rich liquid developers collected from all the photosensitive bodies can be efficiently reused, and the consumption amount of new carrier can be reduced.

The liquid developer system may further include: a storage section liquid level sensor disposed in the storage section; a concentration control unit liquid level sensor disposed in the concentration control unit; a concentration sensor disposed in the concentration control unit; a distribution unit that distributes between the first feed unit and the second feed unit; and a control unit that controls the distribution unit based on at least one of data of the storage section liquid level sensor, data of the concentration control unit liquid level sensor, and data of the concentration sensor. According to this structure, collected liquid developer can be efficiently reused according to the amount of the collected liquid developer and variations in the solid concentration.

In one embodiment, the distribution unit of the liquid developer collecting system is a switching valve. According to this structure, whether the collected liquid developer is to be reused or disposed can be quickly judged according to the amount of the collected liquid developer and variations in the solid concentration.

In another embodiment, the distribution unit is a drive pump disposed between the first feed unit and the second feed unit. In this structure, whether the collected liquid developer is to be reused or disposed can be quickly judged according to the amount of the collected liquid developer and variations in the solid concentration.

An image forming apparatus according to a second aspect of the invention includes: a plurality of photosensitive bodies on which electrostatic latent images are formed; a developing unit that develops the electrostatic latent images by liquid developer to form images; a transfer material to which the images on the photosensitive bodies are transferred; a collection section that collects liquid developer from the photosensitive bodies; at least one storage section that stores liquid developer collected by the collection section; a concentration control unit; and a first feed unit that feeds liquid developer from the storage section to the concentration control unit. According to this structure, an image forming apparatus having a simple structure and capable of reusing liquid developer collected from the photosensitive bodies can be provided.

The image forming apparatus may further include a second feed unit that feeds liquid developer from the storage section to a disposal tank. According to this structure, whether the collected liquid developer is to be reused or disposed can be quickly judged according to the amount of the collected liquid developer and variations in the solid concentration.

The storage section of the image forming apparatus may store liquid developer collected from the photosensitive body to which an image that is transferred first in the transfer material is formed in the plural photosensitive bodies. According to this structure, color mixture that may be caused when collected carrier-rich liquid developer is reused can be prevented.

The storage section may have storage units corresponding to the respective liquid developers collected from the plural photosensitive bodies. According to this structure, carrier-rich liquid developers collected from all the photosensitive bodies can be efficiently reused, and the consumption amount of new carrier can be reduced.

The image forming apparatus may further include a storage section liquid level sensor disposed in the storage section; a concentration control unit liquid level sensor disposed in the concentration control unit; a concentration sensor disposed in the concentration control unit; a distribution unit that distributes between the first feed unit and the second feed unit; and a control unit that controls the distribution unit based on at least one of data of the storage section liquid level sensor, data of the concentration control unit liquid level sensor, and data of the concentration sensor. According to this structure, collected liquid developer can be efficiently reused according to the amount of the collected liquid developer and variations in the solid concentration.

In one embodiment, the distribution unit of the image forming apparatus is a switching valve. According to this structure, whether the collected liquid developer is to be reused or disposed can be quickly judged according to the amount of the collected liquid developer and variations in the solid concentration.

In another embodiment, the distribution unit is a drive pump disposed between the first feed unit and the second feed unit. According to this structure, whether the collected liquid developer is to be reused or disposed can be quickly judged according to the amount of the collected liquid developer and variations in the solid concentration.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
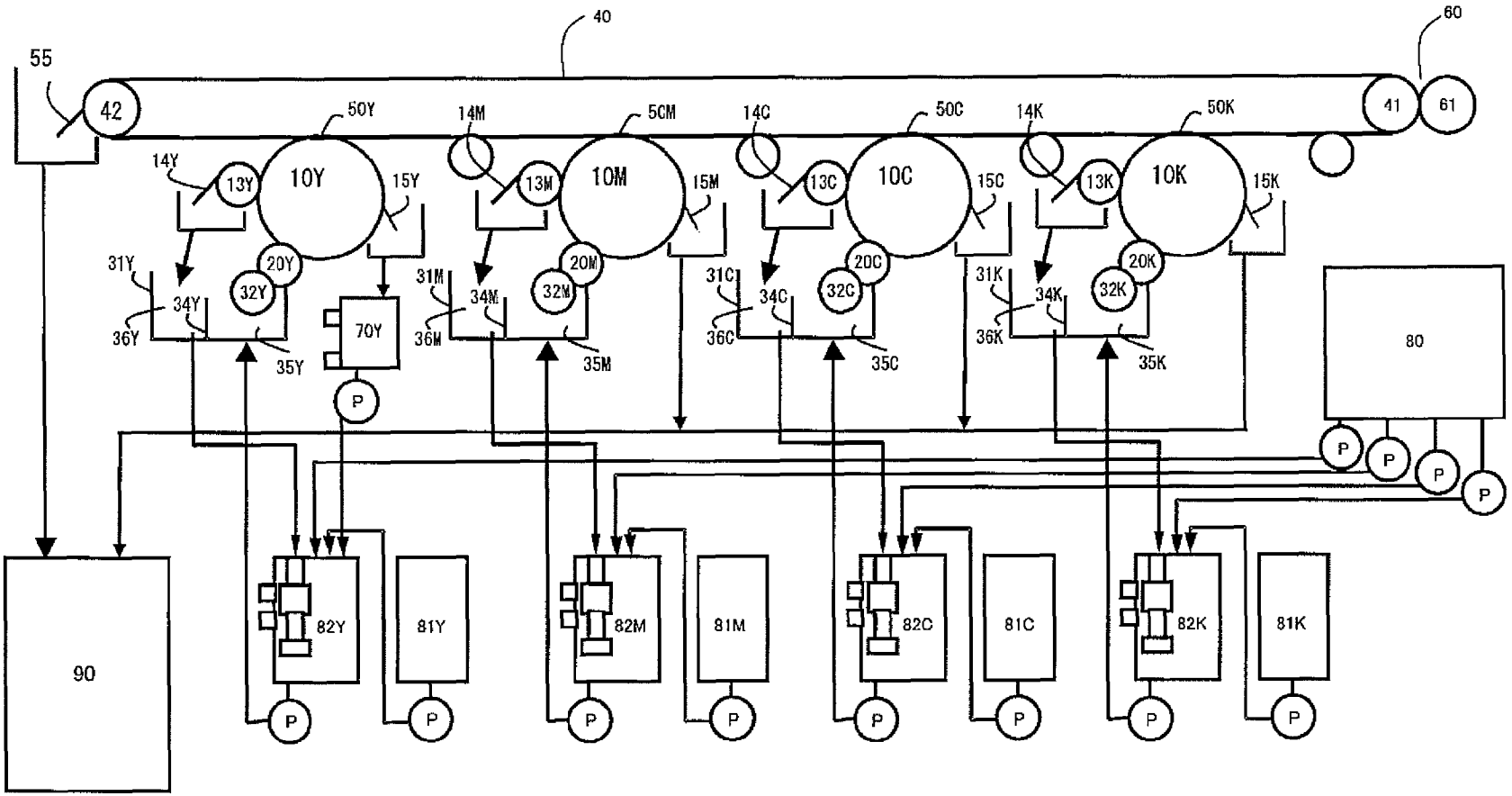
FIG. 1 illustrates an image forming apparatus that includes a liquid developer collecting system according to a first embodiment of the invention.
Figure 2:
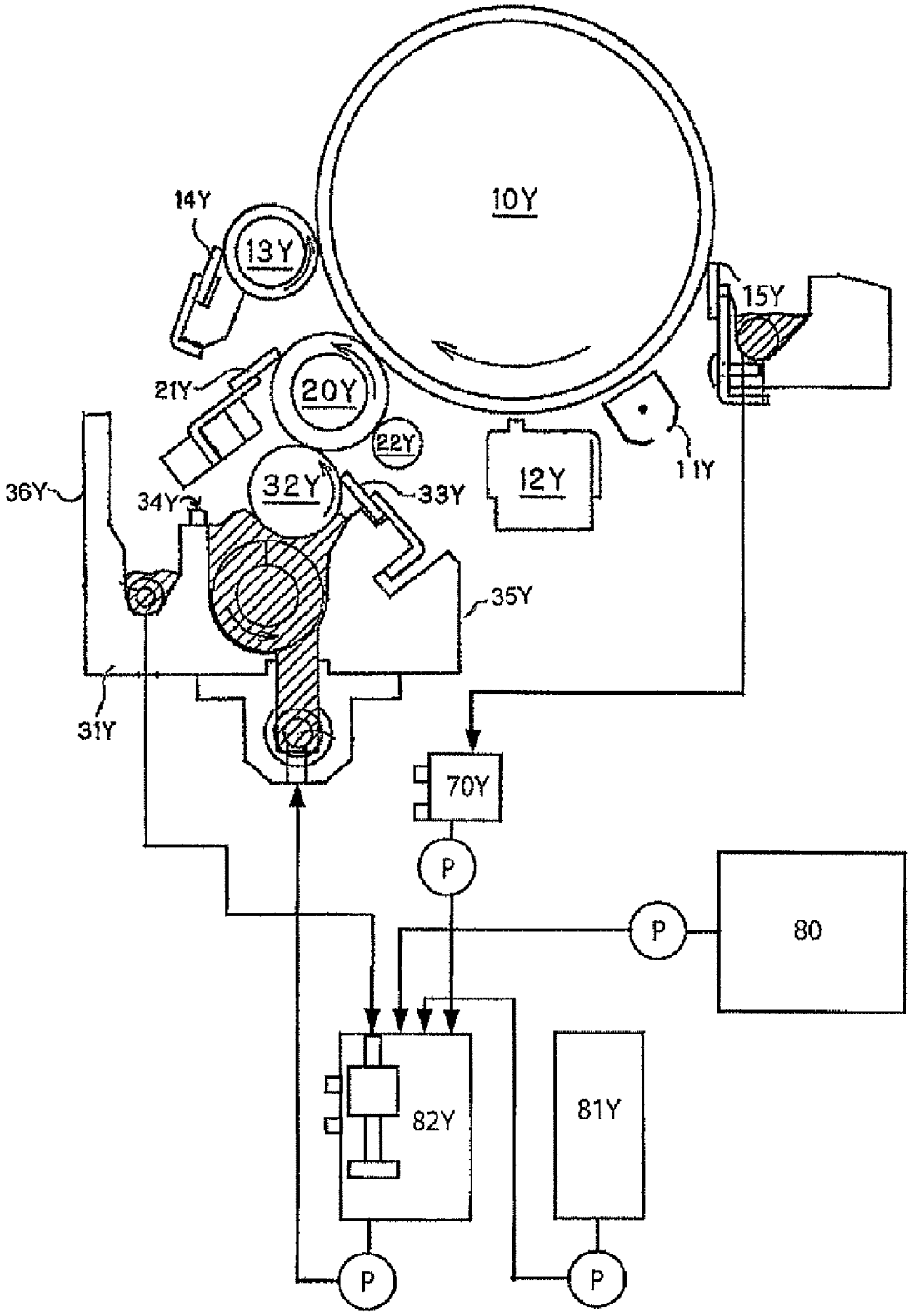
FIG. 2 is an enlarged view of a portion of the image forming apparatus of FIG. 1.

Embodiments according to the invention are hereinafter described with reference to the drawings. FIG. 1 illustrates the main components of an image forming apparatus 1 including a liquid developer collecting system according to a first embodiment of the invention. In FIG. 1, Y, M, C and K representing yellow (Y), magenta (M), cyan (C) and black (K) are added to each reference number given to the same structure element. FIG. 2 is an enlarged view of a portion of image forming apparatus 1 that shows the structure of an image forming section, a developing unit, an intermediate transfer body, and the liquid developer collecting system for yellow (Y).

As illustrated in FIG. 1, image forming apparatus 1 includes photosensitive bodies 10Y, 10M, 10C and 10K as latent image carrier bodies for yellow (Y), magenta (M), cyan (C) and black (K) disposed in tandem. The photosensitive bodies 10Y, 10M, 10C and 10K represent a yellow photosensitive body, a magenta photosensitive body, a cyan photosensitive body, and a black photosensitive body, respectively. Each photosensitive body is constituted by a photosensitive body drum and may have an endless belt shape.

As can be seen from FIG. 2, the image forming section includes a corona electrifier 11Y, an exposure unit 12Y, a developing roller 20Y, a photosensitive squeeze roller 13Y, and a photosensitive body cleaning blade 15Y in the rotation direction (shift direction) of the outer circumference of the photosensitive body 10Y. The photosensitive body squeeze roller 13Y faces and contacts the photosensitive body 10Y between a developing roller 20Y and a primary transfer unit 50Y. The photosensitive squeeze roller 13Y has a squeeze roller cleaning blade 14Y that slidingly contacts and presses the surface of the photosensitive squeeze roller 13Y.

A developing roller cleaning blade 21Y disposed downstream from a developing nip contacts the outer circumference of the developing roller 20Y, and a developer supply roller 32Y using an anilox roller disposed upstream from the developing nip contacts the outer circumference of the developing roller 20Y. A regulating blade 33Y for regulating the developer supply amount contacts the developer supply roller 32Y. A corona electrifier 22Y for electrifying toner is disposed between the developing nip and the developer supply roller 32Y. The developer supply roller 32Y is contained in a developer container (toner reservoir) 31Y which accommodates liquid developer. A primary transfer roller (not shown) of a primary transfer unit 50Y is disposed at a position opposed to the photosensitive body 10Y with an intermediate transfer body 40 interposed between the primary transfer roller and the photosensitive body 10Y. An intermediate transfer body cleaning blade 55 is disposed on the intermediate transfer body 40.

Toner of the liquid developer contained in the developer container 31Y may include particles having an average particle diameter of 1 μm, for example, with colorant such as a known pigment dispersed in a known thermoplastic resin. The liquid carrier may be an insulation liquid carrier such as Isopar (trademarked product of Exxon Co.) in case of low-viscosity low-concentration liquid developer. On the other hand, the liquid carrier may be organic solvent; silicon oil having a flash point of 210° C. or higher such as phenylmethyl siloxane, dimethyl polysiloxaner and polydimetyl cyclosiloxane; mineral oil; aliphatic saturated hydrocarbon having a boiling point of 170° C. or higher and a relatively low viscosity such as 3 mPas at 40° C. such as liquid paraffin; normal paraffin; vegetable oil; edible oil; higher fatty acid ester; or another insulation liquid carrier in the case of a high-viscosity high-concentration liquid developer. For forming liquid developers, toner particles are added to the liquid carrier with dispersant, and the toner solid concentration is set at about 20%.

In the image forming section and the developing unit, the photosensitive body 10Y is uniformly electrified by the corona electrifier 11Y. Then, a modulated laser beam is applied by the exposure unit 12Y which has an optical system such as a semiconductor laser, polygon mirror, and F-θ lens based on inputted image signals to form an electrostatic latent image on the electrified photosensitive body 10Y.

Then, the electrostatic latent image formed on the photosensitive body 10Y is developed by supplying liquid developer to the developing roller 20Y from the developer container 31Y as one of the developer containers containing the liquid developers in the respective colors (yellow in this example) via the developer supply roller 32Y while regulating the supply developer amount by using the regulating blade 33Y. The photosensitive body squeeze roller 13Y contacts the photosensitive body 10Y on which the electrostatic latent image has been developed by the developing roller 20Y to remove excessive carrier. The squeeze roller cleaning blade 14Y contacts the photosensitive body squeeze roller 13Y to collect the liquid developer removed from the photosensitive body 10Y. The photosensitive body squeeze roller 13Y is a conductive elastic roller having an elastic member such as conductive urethane rubber and a fluororesin surface layer on the surface of a metal core.

The intermediate transfer body 40 is an endless belt component wound around a driving roller 41 and following roller 42, and is rotated by the driving roller 41 while contacting the photosensitive bodies 10Y, 10M, 10C and 10K in the primary transfer units 50Y, 50M, 50C and 50K. The primary transfer rollers (not shown) of the primary transfer units SOY, 50M, 50C and 50K are opposed to the photosensitive bodies 10Y, 10M, 10C and 10K with the intermediate transfer body 40 interposed therebetween. The primary transfer units 50Y, 50M, 50C and 50K apply primary transfer bias to toner images in respective colors on the photosensitive bodies 10Y, 10M, 10C and 10K after development at the contact positions with the photosensitive bodies 10Y, 10M, 10C and 10K as transfer positions. Then, the primary transfer units 50Y, 50M, 50C and 50K sequentially transfer the toner images overlapped with one another on the intermediate transfer body 40 so as to form a full-color toner image.

The photosensitive body cleaning blade 15Y contacts at least the photosensitive body 10Y subject to initial transfer to the intermediate transfer body 40 in the plural photosensitive bodies 10Y, 10M, 10C and 10K, and scrapes and collects carrier-rich liquid developer remaining after primary transfer. The collected liquid developer is temporarily stored in the yellow buffer tank 70Y, and fed from the yellow buffer tank 70Y to a yellow concentration control tank 82Y. According to the first embodiment, the buffer tank is provided only on the photosensitive body 10Y subject to initial transfer to the transfer body for feeding to the concentration control tank and reusing liquid developer because color mixture is caused in the liquid developer collected from the photosensitive body disposed at the most upstream position. It is possible to provide the buffer tank for all the photosensitive bodies to reuse the liquid developer collected from all the photosensitive bodies.

A secondary transfer roller 61 of a secondary transfer unit 60 is disposed opposed to the belt driving roller 41 with the intermediate transfer body 40 interposed therebetween. In the secondary transfer unit 60, sheet material such as sheet, film, and fabric is fed and supplied along a sheet material feed path at the same timing when a full-color toner image after color stacking or a monochrome toner image formed on the intermediate transfer body 40 reaches the transfer position of the secondary transfer unit 60. Then, the monochrome or full-color toner image is secondarily transferred on the sheet material by applying secondary transfer bias. A fixing unit (not shown) is disposed before the sheet material feed path to fix the monochrome or full-color toner image transferred on the sheet material to a recording medium (sheet material) by fusing, and thereby final image formation on the sheet material ends.

The intermediate transfer body cleaning blade 55 contacts the intermediate transfer body 40 after secondary transfer to collect remaining liquid developer and feed the collected liquid developer to a disposal tank 90.

The liquid developer collected from the photosensitive squeeze roller 13Y disposed between the primary transfer unit 50Y and the developing position on the photosensitive body 10Y for development by the developing roller 20Y is collected for each color, and fed to a collection section 36Y for reuse.

The developer container 31Y containing liquid developer is sectioned into a storage section 35Y and the collection section 36Y by a partition wall 34Y. The developer supply roller 32Y for supplying liquid developer to the developing roller 20Y is disposed in the storage section 35Y. The developing roller cleaning blade 21Y contacts the outer circumference of the developing roller 20Y at a position downstream from the developing nip for the photosensitive body 10Y to scrape and collect the liquid developer from the developing roller 20Y after development and feed the collected liquid developer to the collection section 36Y.

The carrier-rich liquid developer collected by the photosensitive body cleaning blade 15Y contacting the photosensitive body 10Y after primary transfer is fed to the yellow buffer tank 70Y. The liquid developer collected and temporarily stored in the yellow buffer tank 70Y is fed to the yellow concentration control tank 82Y by a pump as necessary for reuse.

According to the collecting system for collecting carrier-rich liquid developer collected from the photosensitive body by the photosensitive body cleaning blade 15Y in the first embodiment shown in FIGS. 1 and 2, the buffer tank 70Y is provided only on the yellow photosensitive body 10Y subject to initial transfer to the intermediate transfer body 40. In this case, only the carrier-rich liquid developer collected from the yellow photosensitive body 10Y at the most upstream position is fed to the buffer tank 70Y and reused so as to prevent color mixture. The carrier-rich liquid developer collected from the yellow photosensitive body 10Y by the photosensitive body cleaning blade 15Y is fed to the yellow buffer tank 70Y and stored therein. Other liquid developers collected from the photosensitive bodies 10M, 10C and 10K by the photosensitive body cleaning blades 15M, 15C and 15K are sent to the disposal tank 90.

A yellow toner tank 81Y, yellow concentration control tank 82Y, and a common carrier tank 80 for storing new carrier are provided for reusing yellow liquid developer. The common carrier tank 80 communicates with concentration control tanks 82Y, 82M, 82C and 82K provided for each color through feed lines via pumps.

The yellow concentration control tank 82Y receives collected liquid developer from the collection section 36Y of the developing unit, carrier-rich liquid developer collected from the yellow buffer tank 70Y, new toner having a concentration of about 35% from the yellow toner tank 81Y, and new carrier from the common carrier tank 80 through the feed lines via pumps. The yellow concentration control tank 82Y communicates with the storage section 35Y of the developer container 31Y through a feed line via a pump to reuse the collected liquid developer.

A concentration sensor for measuring concentration, a liquid level sensor for measuring liquid level, and a stirring unit are provided in the yellow concentration control tank 82Y. The concentration sensor is of a type such as a light reflection type or a light transmission type. The liquid level sensor is produced, for example, by equipping a plurality of two-valued hall elements disposed in the vertical direction within the concentration control tank and fixing a magnetic force generator to a floating member. The concentration sensor and the liquid level sensor in the concentration control tank 82Y are described later.

The solid concentration of the liquid developer collected by the developing roller cleaning blade 21Y from the developing roller 20Y after development and fed by the collection section 36Y varies according to image data. More specifically, when the image data corresponds to full-tone, many solid particles are shifted to the photosensitive body and consumed. Thus, the solid concentration of the collected liquid developer is low. When the image data corresponds to half-tone, only a small amount of solid particles are shifted to the photosensitive body. In this case, the solid concentration of the collected liquid developer changes little.

The liquid developer scraped by the squeeze roller cleaning blade 14Y from the photosensitive body squeeze roller 13Y that contacts the photosensitive body 10Y after development and prior to the primary transfer and removes the remaining liquid developer to be fed to the collection section 36Y has a large proportion of carrier and a low solid concentration.

The liquid developer collected by the photosensitive body cleaning blade 15Y in contact with the photosensitive body 10Y after primary transfer and temporarily fed to the yellow buffer tank 70Y to be temporarily stored therein has a high proportion of carrier and a low solid concentration.

The amount of the liquid developer supplied to the storage section 35Y of the developer container 31Y is set slightly larger than the liquid developer consumption amount required for development. Thus, the liquid developer supplied to the storage section 35Y overflows the partition wall 34Y toward the collection section 36Y. The concentration of the liquid developer overflowing from the storage section 35Y is adjusted to the target concentration, and thus the concentration does not change.

The amount of the liquid developer collected from the developing roller 20Y by the developing roller cleaning blade 21Y after development is the largest in those of the collected liquid developers flowing into the collection section 36Y of the developer container 31Y. Moreover, the solid concentration of the liquid developer collected from the developing roller 20Y varies the largest. Thus, the solid concentration of the liquid developer collected from the developing roller 20Y influences the solid concentration of the overall collected liquid developers.

The capacity of the concentration control tank 82Y for adjusting the concentration of the collected liquid developer to the target concentration for reuse needs to be small since the concentration control tank is equipped for each color for prevention of color mixture. For example, when a new toner having a solid concentration of 35% and contained in the toner tank 81Y is supplied and stirred to adjust the solid concentration of 17% of the liquid developer collected and contained in the concentration control tank 82Y to the target solid concentration of 20%, the concentration control tank 82Y needs to have a remaining capacity to which the new toner is supplied.

However, when the solid concentration of the liquid developer fed from the collection section 36Y of the developer container 31Y is lower than a predetermined value, a large volume of new high-concentration toner needs to be supplied to the concentration control tank 82Y so as to adjust to the target concentration. According to a structure that imposes limitations to the capacity of the concentration control tank 82Y, however, it is difficult to efficiently control the solid concentration.

When the carrier-rich liquid developer collected by the photosensitive body cleaning blade 15Y from the photosensitive body 10Y is directly fed to the concentration control tank 82Y under this condition, the solid concentration further decreases and is difficult to control. According to the liquid developer collecting system in the first embodiment, therefore, the carrier-rich liquid developer collected from the yellow photosensitive body 10Y disposed at the most upstream position and causing no color mixture is temporarily stored in the yellow buffer tank 70Y. When carrier needs to be supplied at the time of concentration control of the liquid developer collected from the collection section 36Y in the yellow concentration control tank 82Y, carrier-rich liquid developer is supplied from the yellow buffer tank 70Y to reuse the liquid developer instead of supply of new carrier from the carrier tank 80.

For this purpose, the liquid level sensor is disposed in the yellow buffer tank 70Y. When it is judged that supply of carrier is needed based on measurement data obtained from the concentration sensor and the liquid level sensor disposed in the yellow concentration control tank 82Y, the storage amount is detected by the liquid level sensor in the yellow buffer tank 70Y. Then, the pump is driven by a control unit to supply a predetermined amount of the collected carrier-rich liquid developer to the yellow concentration control tank 82Y in place of new carrier.

By temporarily storing the collected carrier-rich liquid developer and reusing the liquid developer instead of new carrier, the consumption amount of new carrier can be reduced, and concentration control for reuse can be efficiently performed by using the concentration control unit.

Figure 3:
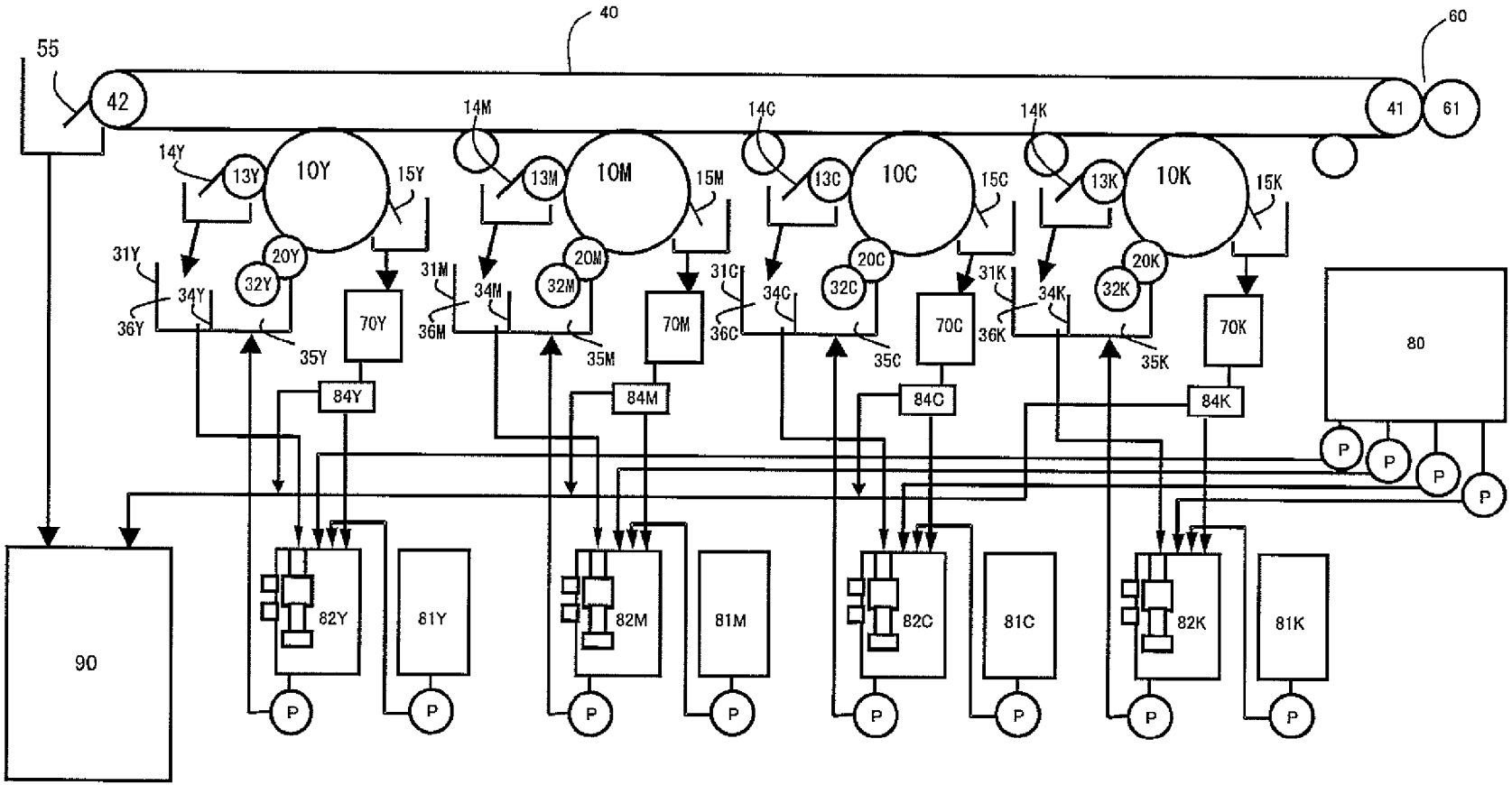
FIG. 3 illustrates an image forming apparatus that includes a liquid developer collecting system according to a second embodiment of the invention.
Figure 4:
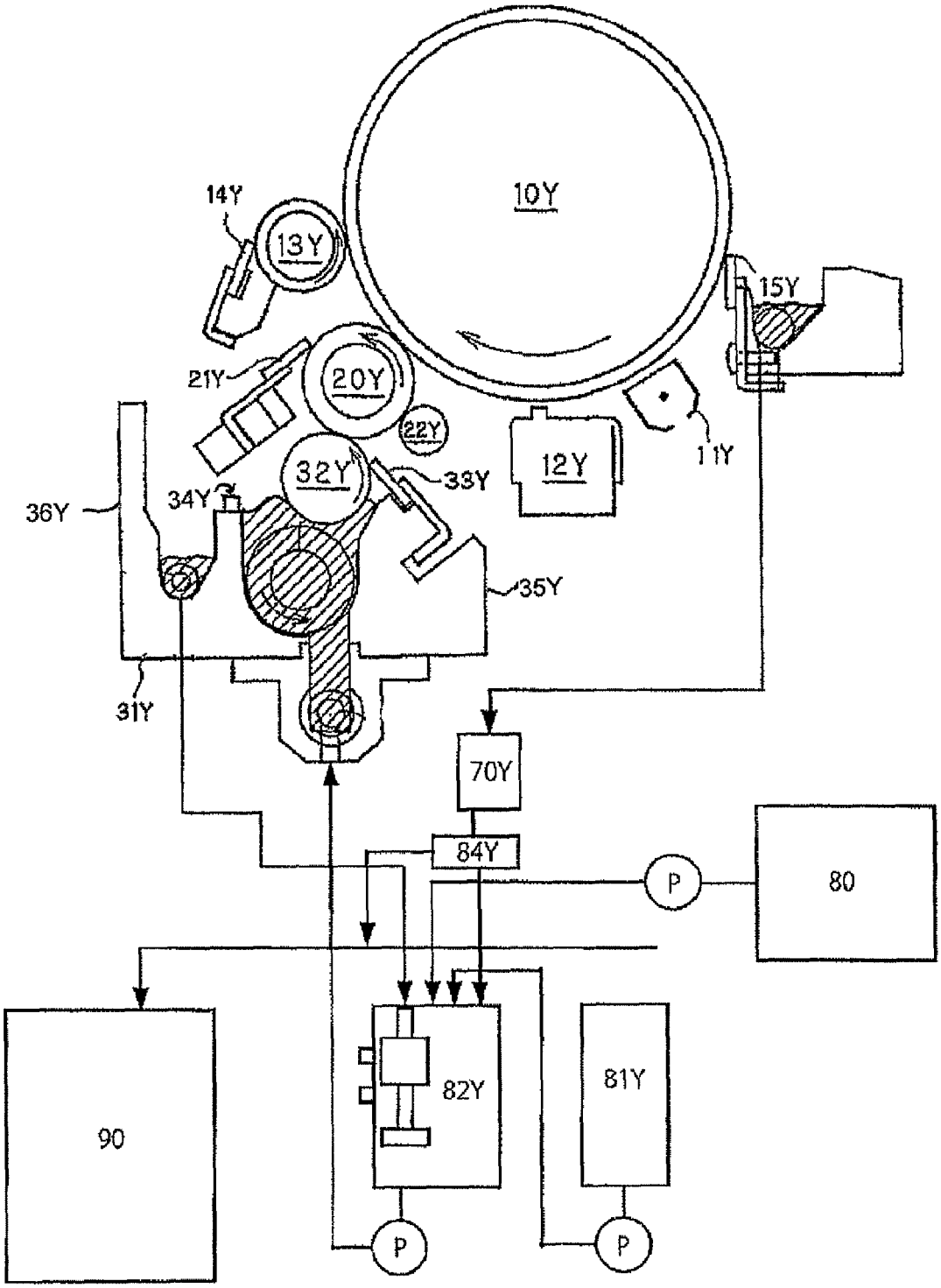
FIG. 4 is an enlarged view of a portion of the image forming apparatus of FIG. 3.

FIG. 3 illustrates the main components of an image forming apparatus including a liquid developer collecting system according to a second embodiment of the invention. In FIG. 3, Y, M, C and K representing yellow (Y), magenta (M), cyan (C) and black (K) are added to each reference number given to the same structure element. FIG. 4 is an enlarged view of a portion of the image forming apparatus of FIG. 3 showing the structure of an image forming section, a developing unit, an intermediate transfer body, and the liquid developer collecting system for yellow (Y).

The image forming apparatus including the liquid developer collecting system in the second embodiment has the buffer tanks 70Y, 70M, 70C and 70K for temporarily storing carrier-rich liquid developers collected from the photosensitive bodies 10Y, 10M, 10C and 10K by using the photosensitive body cleaning blades 15Y, 15M, 15C and 15K. Moreover, the buffer tanks 70Y, 70M, 70C and 70K provided for each color communicate with distribution units 84Y, 84M, 84C and 84K. Each of the distribution units 84Y, 84M, 84C and 84K distributes the collected carrier-rich liquid developer between the concentration control tanks 82Y, 82M, 82C and 82K and the disposal tank 90. Each of the distribution units 84Y, 84M, 84C and 84K in this embodiment has an electromagnetic switching valve that can switch between a first position for stopping supply of the liquid developers collected from the buffer tanks 70Y, 70M, 70C or 70K, a second position for supplying the collected liquid developers to the concentration control tanks 82Y, 82M, 82C or 82K, and a third position for supplying the collected liquid developer to the disposal tank 90. The electromagnetic switching valve is controlled by a control unit such that an appropriate position of the first through third positions can be selected.

Each of the buffer tanks 70Y, 70M, 70C and 70K contains the liquid level sensor. Each of the concentration control tanks 82Y, 82M, 82C and 82K contains both the liquid level sensor and the concentration sensor. When it is judged that carrier needs to be supplied at the time of concentration control under the condition where the measurement values of the liquid level sensors of the concentration control tanks 82Y, 82M, 82C and 82K are a predetermined value or lower, the control unit changes the electromagnetic switching valves of the distribution units 84Y, 84M, 84C and 84K from the first position to the second position and drives the pump so that a predetermined amount of collected carrier-rich liquid developer can be supplied to the concentration control tanks 82Y, 82M, 82C and 82K.

When the liquid level sensors disposed in the concentration control tanks 82Y, 82M, 82C and 82K indicate a predetermined liquid level or higher, it is judged that supply of carrier at the time of concentration control is not necessary. Then, the control unit switches the distribution unit to the third position and drives the pump such that the collected carrier-rich liquid developer contained in the buffer tanks 70Y, 70M, 70C and 70K can be fed to the disposal tank 90.

According to the structure capable of feeding the collected carrier-rich liquid developer contained in the buffer tanks 70Y, 70M, 70C and 70K both to the concentration control tanks 82Y, 82M, 82C and 82K and the disposal tank 90 by using the distribution unit, concentration control can be efficiently performed according to the vacant capacities of the concentration control tanks 82Y, 82M, 82C and 82K.

Figure 5:
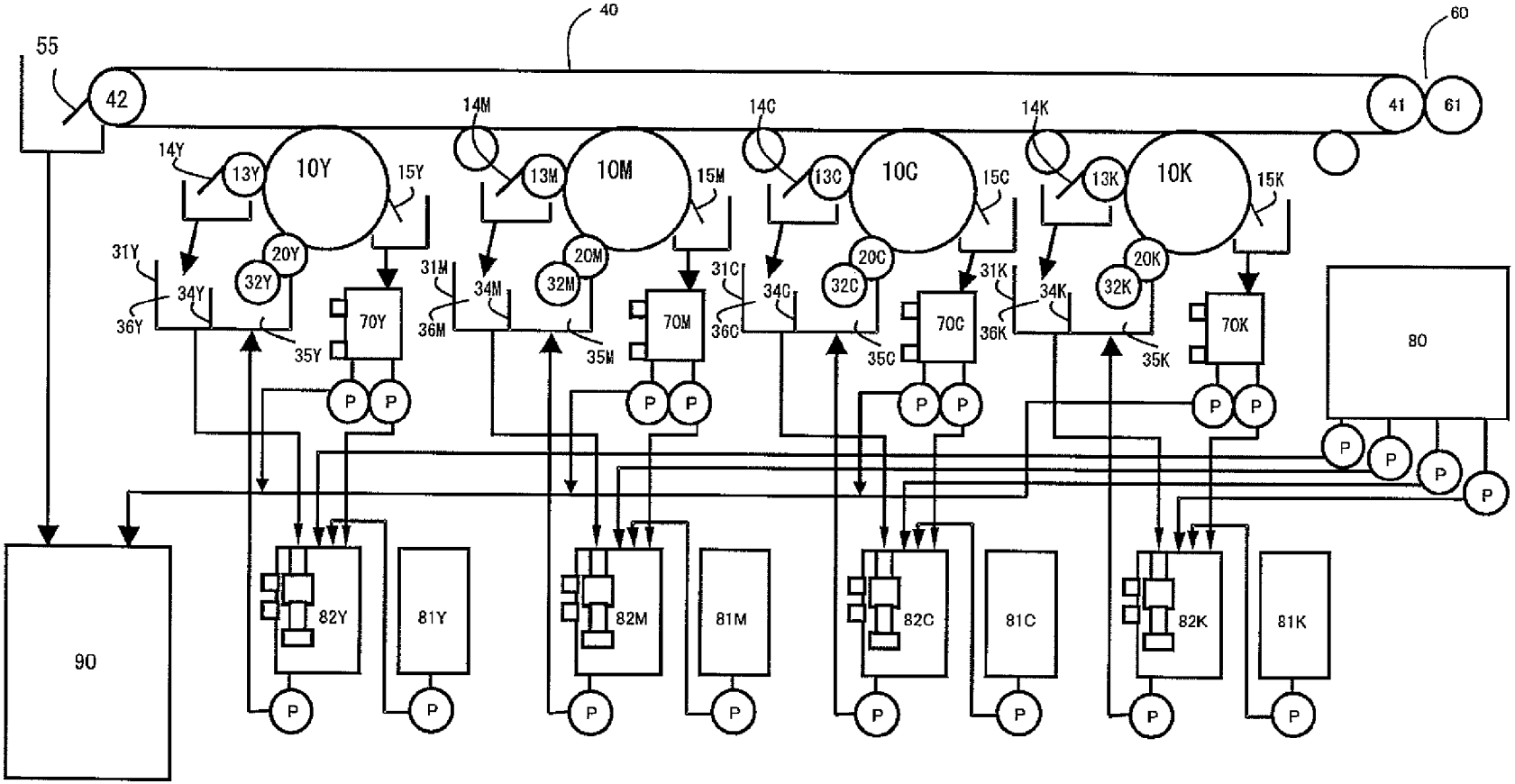
FIG. 5 illustrates an image forming apparatus that includes a liquid developer collecting system according to a third embodiment of the invention.
Figure 6:
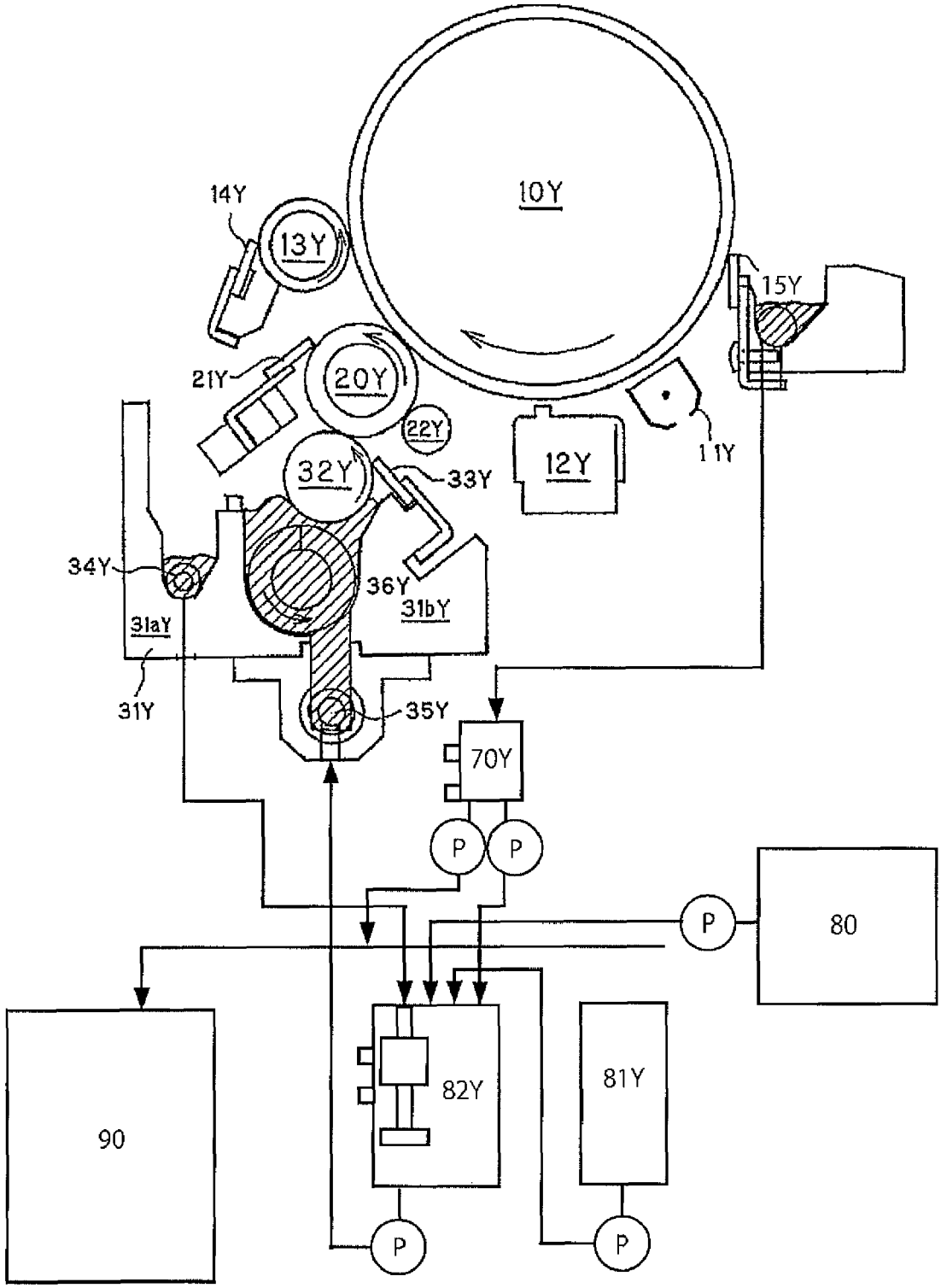
FIG. 6 is an enlarged view of a portion of the image forming apparatus of FIG. 5.

FIG. 5 illustrates the main components of an image forming apparatus including a liquid developer collecting system according to a third embodiment of the invention. In FIG. 5, Y, M, C and K representing yellow (Y), magenta (M), cyan (C) and black (K) are added to each reference number given to the same structure element. FIG. 6 is an enlarged view of the image forming apparatus of FIG. 5 showing the structure of an image forming section, a developing unit, an intermediate transfer body, and the liquid developer collecting system for yellow (Y).

The image forming apparatus including the liquid developer collecting system in the third embodiment has the buffer tanks 70Y, 70M, 70C and 70K for temporarily storing carrier-rich liquid developer collected from the photosensitive bodies 10Y, 10M, 10C and 10K by using the photosensitive body cleaning blades 15Y, 15M, 15C and 15K. Moreover, the buffer tanks 70Y, 70M, 70C and 70K provided for each color communicate with the concentration control tanks 82Y, 82M, 82C and 82K and the disposal tank 90 via separate drive pumps. According to the third embodiment, the drive pump for feeding the collected carrier-rich liquid developer to the concentration control tanks 82Y, 82M, 82C and 82K from the buffer tanks 70Y, 70M, 70C and 70K, and the drive pump for feeding the liquid developer to the disposal tank 90 from the buffer tanks 70Y, 70M, 70C and 70K are operated as the distribution unit under the control of the control unit. Other structures are similar to that of the second embodiment, and thus are not explained again.

Figure 7:
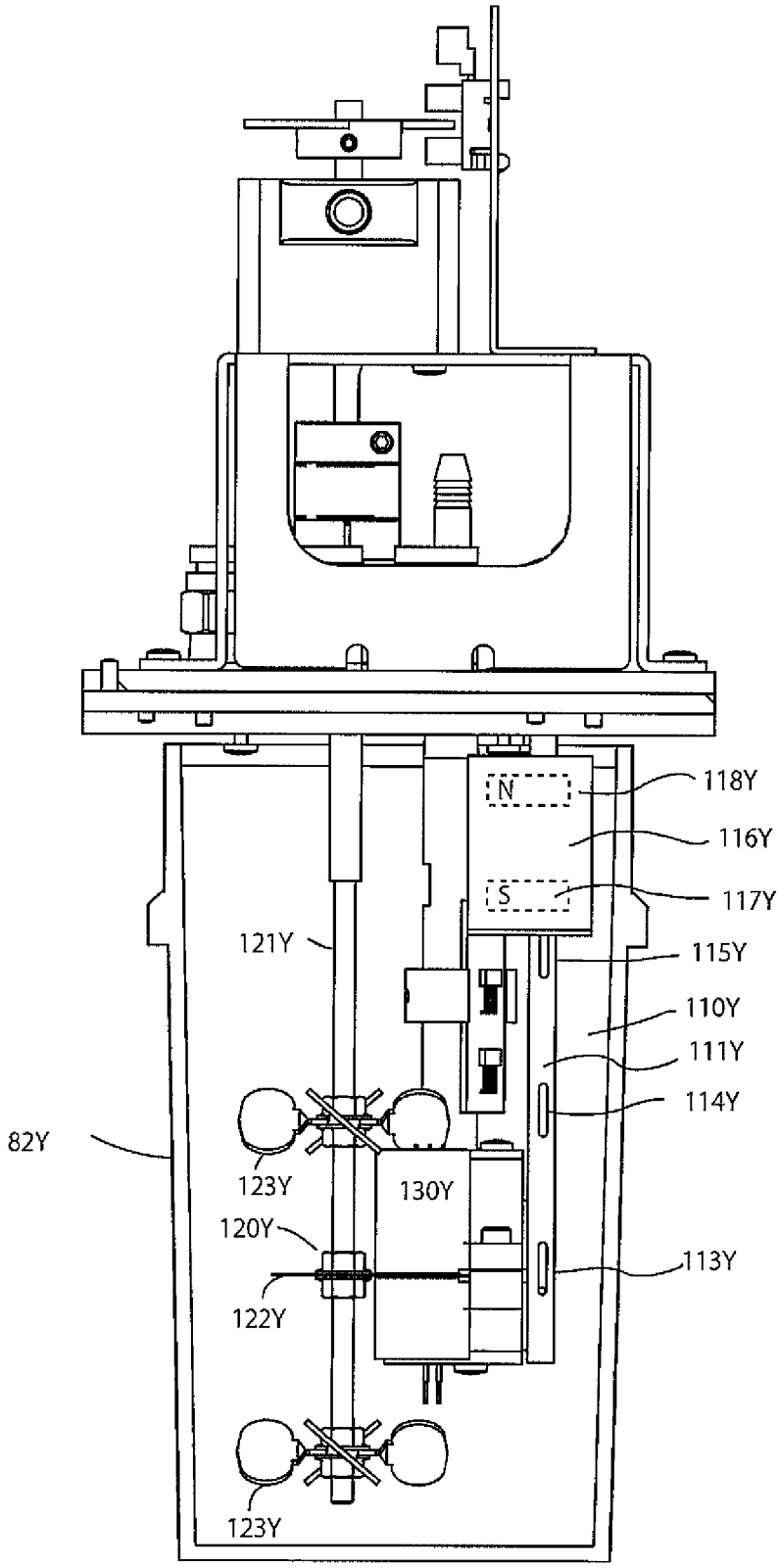
FIG. 7 illustrates a concentration control tank according to the invention.

The concentration and liquid level of the liquid developer are measured by the concentration sensor and the liquid level sensor disposed in the concentration control tank 82Y. A liquid amount measuring device 110Y as the liquid level sensor is first explained. As illustrated in FIG. 7, the liquid amount measuring device 110Y has a float support member 111Y, a first hall device 113Y as an example of a proportional output type hall device, a second hall device 114Y, a third hall device 115Y, a float 116Y as an example of a float member, a first magnetic field generator 117Y, and a second magnetic field generator 118Y.

The float support member 111Y is constituted by a component supporting the float 116Y such that the float 116Y can shift from the surface of the liquid in the yellow concentration control tank 82Y approximately to the bottom below the liquid surface. The first hall device 113Y, the second hall device 114Y, and the third hall device 115Y are provided in this order from the lower position with a predetermined distance left between one another.

The first hall device 113Y, the second hall device 114Y, and the third hall device 115Y are constituted by proportional output type hall devices that vary output voltage relative to magnetic flux density. In this embodiment, each distance between the hall devices is set at 30 mm.

The float 116Y floats on the liquid surface and shifts with respect to the float support member 111Y according to the liquid surface position. The float 116Y has a first magnetic field generator 117Y at the lower position, and a second magnetic field generator 118Y at the upper position with a predetermined distance left therebetween. The first magnetic field generator 117Y and the second magnetic field generator 118Y shift such that these generators 117Y and 118Y come opposed to the respective hall devices 113Y, 114Y and 115Y in accordance with the shift of the float 116Y. The first magnetic field generator 117Y and the second magnetic field generator 118Y are positioned such that N pole and S pole are located opposite for each magnetic generator. In this embodiment, each of the magnetic field generators 117Y and 118Y has a diameter of 5 mm and a length of 6 mm, and generates a 4,000 Gauss magnetic field, and the respective magnetic field generators 117Y and 118Y are disposed with a distance of 20 mm left between each other. The liquid level sensor provided in each of the buffer tanks 70Y, 70M, 70C and 70K in the second and third embodiments has a structure similar to that of the liquid level sensor disposed in each of the concentration control tanks 82Y, 82M, 82C and 82K.

A concentration measuring device 120Y as the concentration sensor has a stirring propeller shaft 121Y, a transparent propeller 122Y as an example of a shift member, a stirring propeller 123Y as an example of a stirring member, and a concentration measuring unit 130Y. The stirring propeller shaft 121Y is a shaft on which the transparent propeller 122Y and the stirring propeller 123Y are coaxially provided, and rotated by a motor.

Figure 8:
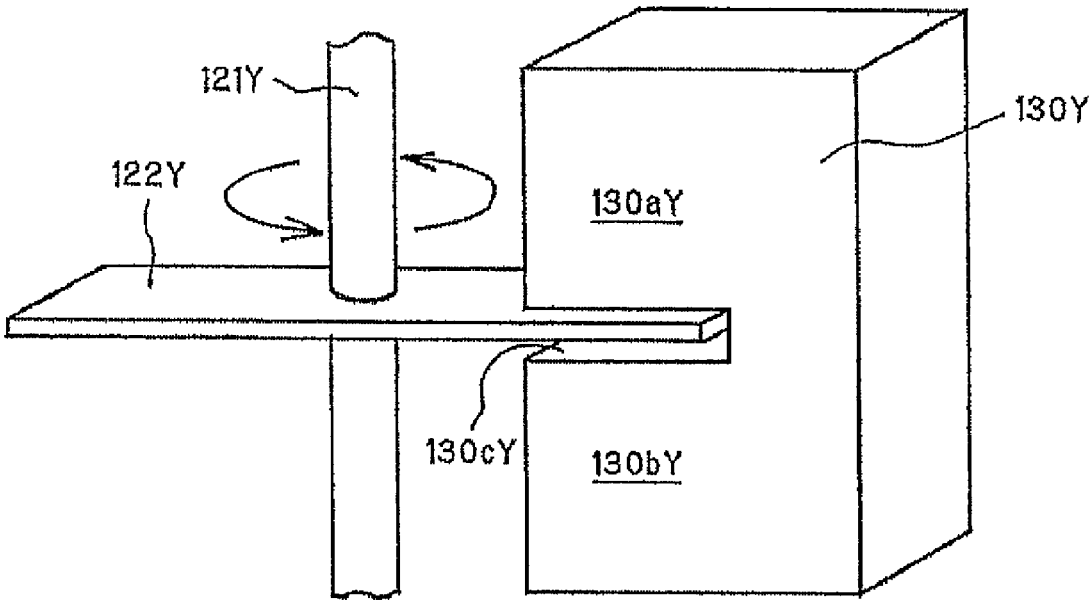
FIG. 8 illustrates a concentration measuring unit and a transparent propeller according to the invention.

A concentration detection method using the concentration measuring unit 130Y and the transparent propeller 122Y is now explained. As illustrated in FIG. 8, the transparent propeller 122Y is a rectangular or other flat-plate-shaped rotatable component that is supported by a stirring propeller shaft 121Y, and intermittently passes through a clearance 130*c*Y formed between a first member 130*a*Y and a second member 130*b*Y of the concentration measuring unit 130Y. The first member 130*a*Y and the second member 130*b*Y are movable to vary the length of the clearance 130*c*Y. The length of the clearance 130*c*Y can be varied according to the color of the liquid developer.

Figure 9A:
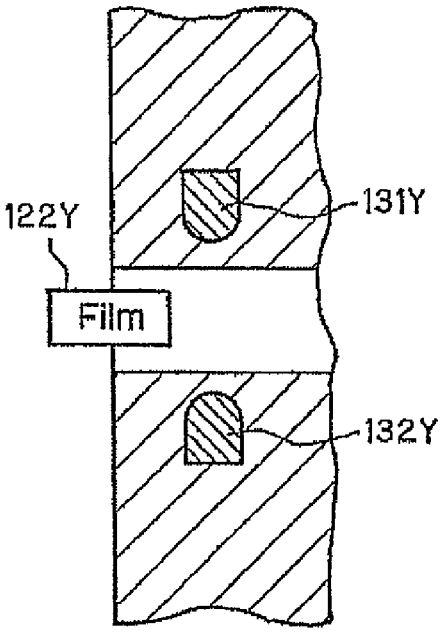
FIGS. 9A and 9B are cross-sectional views of a transmission type concentration measuring unit according to the invention.
Figure 9B:
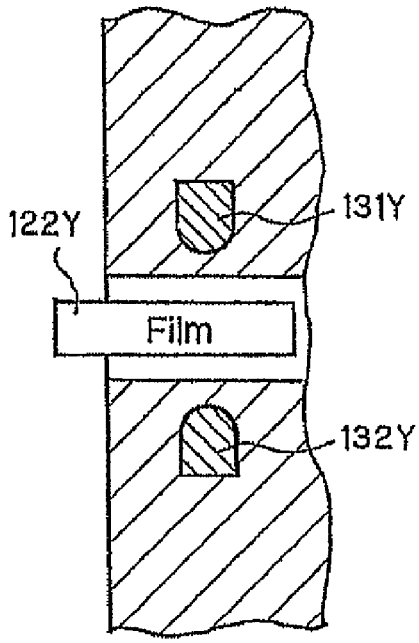

According to the transmission type concentration measuring unit 130Y shown in FIGS. 9A and 9B, a light emission LED 131Y and a concentration measurement light receiving element 132Y as an example of a concentration measuring member are disposed opposed to each other with the clearance 130*c*Y interposed therebetween. An emission light intensity measurement light receiving element 133Y is disposed on the light emission LED 131Y side.

Figure 10:
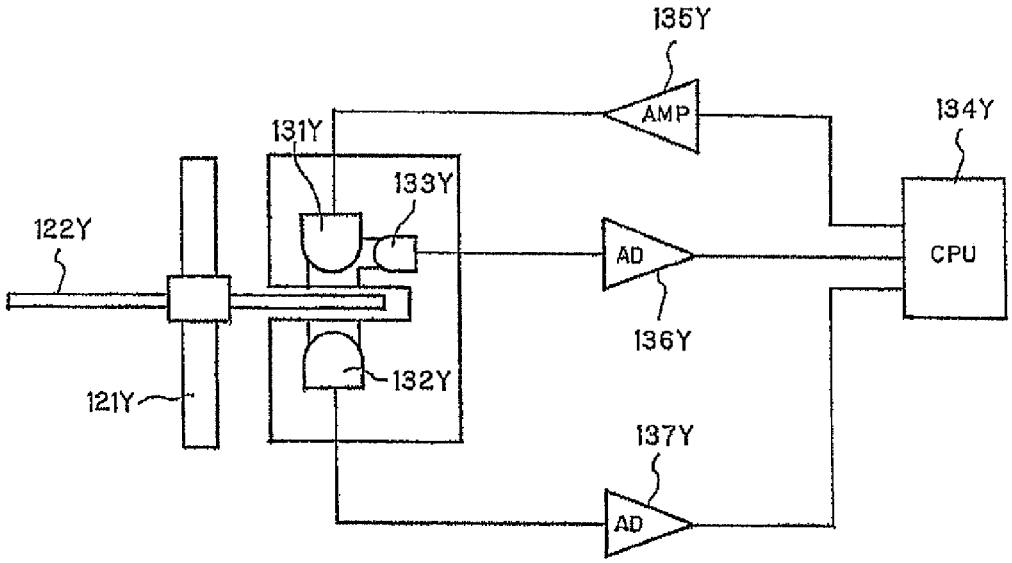
FIG. 10 is a circuit diagram illustrating a configuration of the transmission type concentration measuring unit according to the invention.

As illustrated in FIG. 10, the light emission LED 131Y, the concentration measurement light receiving element 132Y, and the emission light intensity measurement light receiving element 133Y are connected with a CPU 134Y. The light emission LED 131Y is connected with the CPU 134Y via an amplifier 135Y, the concentration measurement light receiving element 132Y is connected with the CPU 134Y via a first A/D converter 136Y, and the emission light intensity measurement light receiving element 133Y is connected with the CPU 134Y via a second A/D converter 137.

Figure 11:
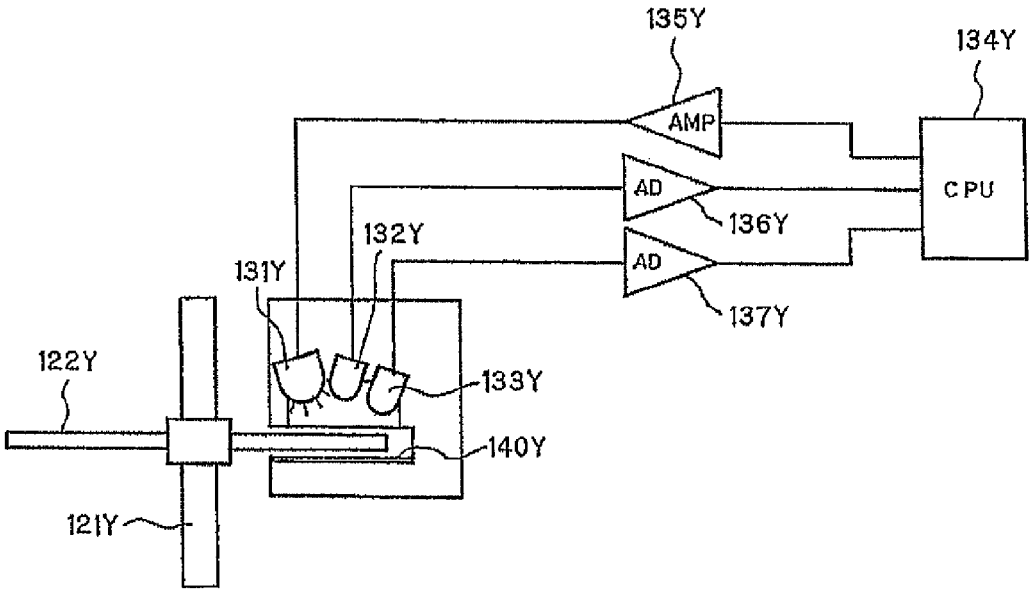
FIG. 11 is a circuit diagram illustrating a configuration of a reflective type concentration measuring unit according to the invention.

According to the reflection type concentration measuring unit 130Y shown in FIG. 11, the light emission LED 131Y, the concentration measurement light receiving element 132Y, and the emission light intensity measurement light receiving element 133Y are disposed on one side of the clearance 130*c*Y. A reflection film 140Y is provided on the other side of the clearance 130*c*Y.

In this structure, light emitted from the light emission LED 131Y has an optical path that passes the liquid developer on the light emission LED 131Y side from the transparent propeller 122Y, the transparent propeller 122Y, and the liquid developer on the reflection film 140Y side. Then, the light is reflected by the reflection film 140Y, and passes the liquid developer on the reflection film 140Y side, the transparent propeller 122Y, and the liquid developer on the concentration measurement light receiving element 132Y side from the transparent propeller 122Y to be received by the concentration measurement light receiving element 132Y. The light emitted from the light emission LED 131Y also has an optical path that passes the liquid developer on the light emission LED 131Y side from the transparent propeller 122Y to be received by the emission light intensity measurement light receiving element 133Y.

The light emission LED 131Y, the concentration measurement light receiving element 132Y, and the emission light intensity measurement light receiving element 133Y are connected with the CPU 134Y. The light emission LED 131Y is connected with the CPU 134Y via the amplifier 135Y, the concentration measurement light receiving element 132Y is connected with the CPU 134Y via the first A/D converter 136Y, and the emission light intensity measurement light receiving element 133Y is connected with the CPU 134Y via the second A/D converter 137Y.

Figure 12:
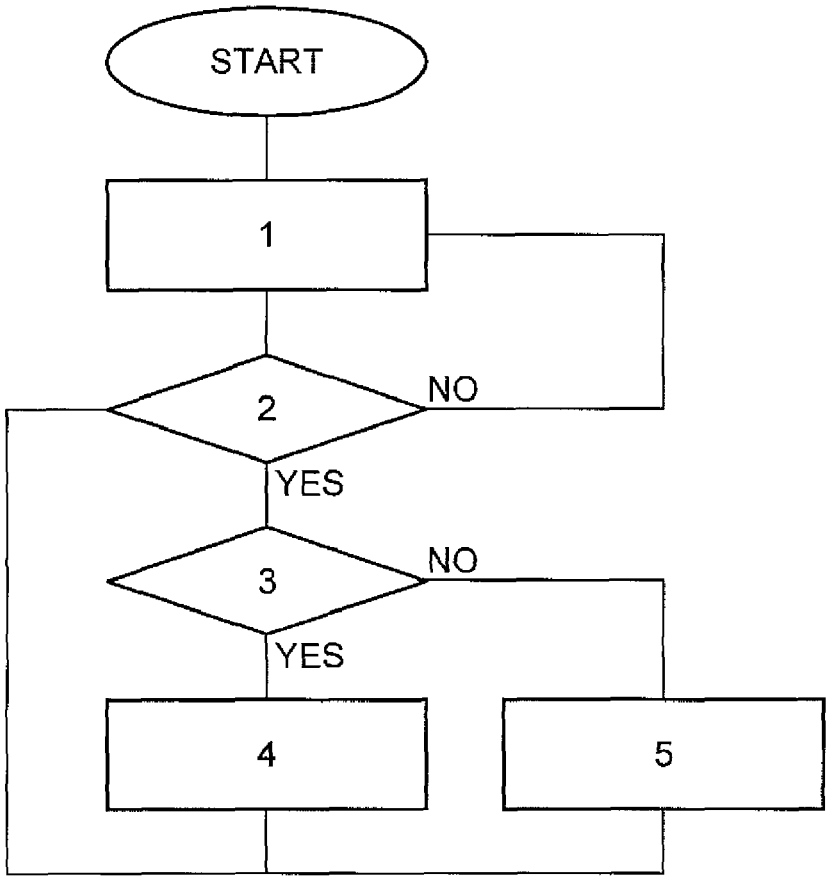
FIG. 12 is a flowchart of a sequence of processes performed by a liquid developer collecting system according to embodiments of the invention.

FIG. 12 is a flowchart showing an example of a sequence of processes performed by a liquid developer collecting system according to embodiments of the invention. In step (1), the concentration and liquid level are initially measured by the concentration measuring device 120Y and the liquid amount measuring device 110Y disposed in the concentration control tank 82Y. Then, it is judged whether supply of carrier to the concentration control tank 82Y is necessary in step (2). When YES in step (2), the process goes to step (3). In step (3), it is judged whether a predetermined amount of collected carrier-rich liquid developer exists based on the data of the liquid level sensor disposed in the buffer tank 70Y. When YES in step (3), the process goes to step (4). When NO in step (3), the process goes to step (5). In step (4), the predetermined amount of the collected carrier-rich liquid developer in the buffer tank 70Y is fed to the concentration control tank 82Y via the distribution unit 84Y. In step (5), a predetermined amount of new carrier is fed to the concentration control tank 82Y from the common carrier tank 80 by actuating the pump.

Figure 13:
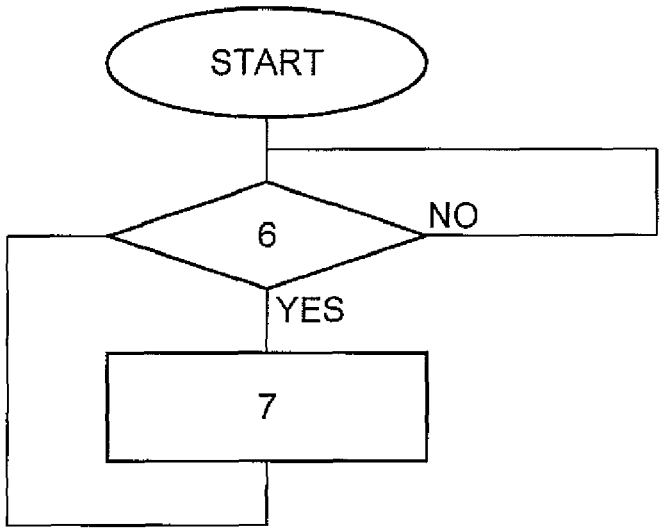
FIG. 13 is a flowchart of a sequence of processes performed by the liquid developer collecting system according to the third embodiment of the invention.

FIG. 13 is a flowchart showing an example of a sequence of processes performed by the liquid developer collecting system in the third embodiment when the collected liquid developer contained in the buffer tank 70Y is fed to the disposal tank 90. Initially, in step (6), the liquid amount measuring device 110Y disposed in the concentration control tank 82Y judges whether the liquid level of the concentration control tank 82Y is a predetermined value (118 mm) or higher. When YES in step (6), the process goes to step (7). In step (7), the collected liquid developer contained in the buffer tank 70Y is fed to the disposal tank 90 at a liquid feed speed of 160 ml/min by actuating the pump for 30 seconds. After 30 seconds, the process returns to step (6), and the liquid amount measuring device 110Y disposed in the concentration control tank 82Y judges whether the liquid level of the concentration control tank 82Y is the predetermined value (118 mm) or higher.

According to the sequence performed by the liquid developer collecting system in the third embodiment shown in the flowchart in FIG. 13, the liquid amount measuring device 110Y disposed in the concentration control tank 82Y initially judges in step (6) whether the liquid level of the concentration control tank 82Y is a predetermined value (115 mm) or higher. When YES in step (6), the process goes to step (7). In step (7), the electromagnetic valve of the distribution unit 84Y is changed to feed the collected liquid developer contained in the buffer tank 70Y to the disposal tank 90 for one minute. After one minute, the process returns to step (6), and the liquid amount measuring device 110Y disposed in the concentration control tank 82Y judges whether the liquid level of the concentration control tank 82Y is the predetermined value (115 mm) or higher.

Figure 14:
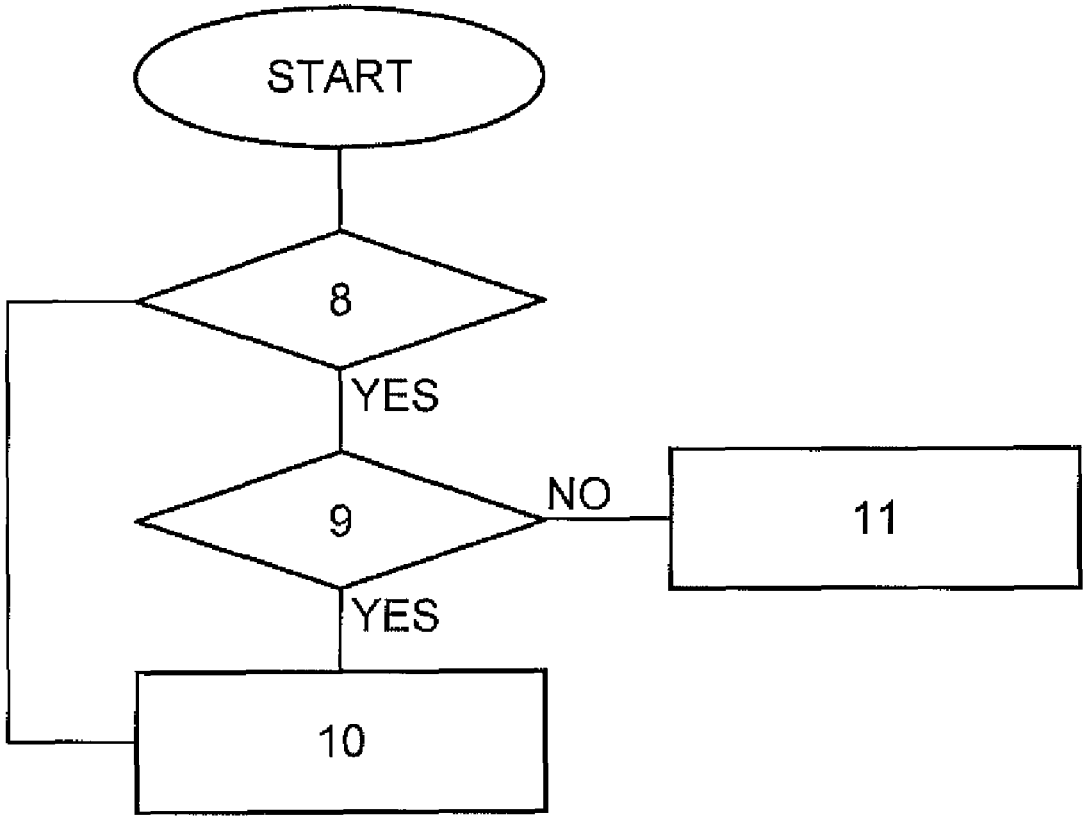
FIG. 14 is a flowchart of a sequence of processes performed by the liquid developer collecting system according to the third embodiment of the invention.

According to the sequence performed by the liquid developer collecting system in the third embodiment shown in a flowchart in FIG. 14, the liquid amount measuring device 110Y disposed in the concentration control tank 82Y initially judges in step (8) whether the liquid level of the concentration control tank 82Y is a predetermined value or higher. When YES in step (8), the process goes to step (9). In step (9), it is judged whether the buffer tank 70Y is full based on the detection result of a full-detection sensor disposed in the buffer tank 70Y. When the buffer tank 70Y is full (YES) in step (9), the process goes to step (10). In step (10), the collected liquid developer in the buffer tank 70Y is fed to the disposal tank 90 by actuating the pump for seconds. After 5 seconds, the process returns to step (8), and the liquid amount measuring device 110Y disposed in the concentration control tank 82Y judges whether the liquid level of the concentration control tank 82Y is a predetermined value or higher. When the buffer tank 70Y is not full ((NO) in step (9)), the process goes to step (11). In step (11) actuation of the pump for feeding the liquid to the disposal tank 90 is stopped.

According to the liquid developer collecting system of the embodiments of the invention, therefore, the consumption amount of new carrier is reduced, and the concentration of liquid developer efficiently collected by the simplified structure is controlled. Accordingly, reduction of space for disposing the devices and reduction of the size of the image forming apparatus are achieved.

What is claimed is:

1. A liquid developer collecting system, comprising:
- a photosensitive body that carries a latent image;
- a collection section that collects liquid developer from the photosensitive body;
- a storage section that stores liquid developer collected by the collection section;
- a concentration control unit that controls a concentration of liquid developer;
- a first feed unit that feeds liquid developer from the storage section to the concentration control unit;
- a disposal tank that stores waste liquid developer:
- a second feed unit that feeds liquid developer from the storage section to the disposal tank;
- a storage section liquid level sensor disposed in the storage section;
- a concentration control unit liquid level sensor disposed in the concentration control unit;
- a concentration sensor disposed in the concentration control unit;
- a distribution unit that distributes between the first feed unit and the second feed unit; and
- a control unit that controls the distribution unit based on at least one of data of the storage section liquid level sensor, data of the concentration control unit liquid level sensor, and data of the concentration sensor.

2. The liquid developer collecting system according to claim 1, wherein the distribution unit is a switching valve.

3. The liquid developer collecting system according to claim 1, wherein the distribution unit is a first drive pump disposed in the first feed unit and a second drive pump disposed in the second feed unit.

4. An image forming apparatus, comprising:
- a photosensitive body on which electrostatic latent images are formed;
- a developing unit that develops the electrostatic latent images by liquid developer to form images;
- a transfer material to which the images on the photosensitive body are transferred;
- a collection section that collects liquid developer from the photosensitive body, bodies;
- a storage section that stores liquid developer collected by the collection section;
- a concentration control unit;
- a first feed unit that feeds liquid developer from the storage section to the concentration control unit;
- a second feed unit that feeds liquid developer from the storage section to a disposal tank;
- a storage section liquid level sensor disposed in the storage section;
- a concentration control unit liquid level sensor disposed in the concentration control unit;
- a concentration sensor disposed in the concentration control unit;
- a distribution unit that distributes between the first feed unit and the second feed unit; and
- a control unit that controls the distribution unit based on at least one of data of the storage section liquid level sensor, data of the concentration control unit liquid level sensor, and data of the concentration sensor.

5. The image forming apparatus according to claim 4, wherein the distribution unit is a switching valve.

6. The image forming apparatus according to claim 4, wherein the distribution unit is a first drive pump disposed in the first feed unit and a second drive pump disposed in the second feed unit.

* * * * *